US010857823B2

(12) United States Patent
Bortolato et al.

(10) Patent No.: US 10,857,823 B2
(45) Date of Patent: Dec. 8, 2020

(54) SYSTEM AND METHOD FOR TRANSFERRING GRAPHICAL IMAGES ON AN OBJECT BY SUBLIMATION

(71) Applicants: Robert Bortolato, Carate Brianza (IT); Gianluca Gastaldello, Verona (IT)

(72) Inventors: Robert Bortolato, Carate Brianza (IT); Gianluca Gastaldello, Verona (IT)

( * ) Notice: Subject to any disclaimer, the term of this patent is extended or adjusted under 35 U.S.C. 154(b) by 0 days.

(21) Appl. No.: 16/483,683

(22) PCT Filed: Feb. 27, 2018

(86) PCT No.: PCT/IB2018/051240
§ 371 (c)(1),
(2) Date: Aug. 5, 2019

(87) PCT Pub. No.: WO2018/158687
PCT Pub. Date: Sep. 7, 2018

(65) Prior Publication Data

US 2020/0016914 A1 Jan. 16, 2020

(30) Foreign Application Priority Data

Feb. 28, 2017 (IT) ..... 102017000022378

(51) Int. Cl.
*B41M 5/382* (2006.01)

(52) U.S. Cl.
CPC ..... *B41M 5/38221* (2013.01)

(58) Field of Classification Search
CPC ..... B41M 5/38221
See application file for complete search history.

(56) References Cited

U.S. PATENT DOCUMENTS

2009/0320748 A1 12/2009 Fenzi

FOREIGN PATENT DOCUMENTS

| | | | |
|---|---|---|---|
| CA | 2528713 | A1 | 6/2007 |
| EP | 1752305 | A1 | 2/2007 |
| EP | 1944175 | A2 | 7/2008 |
| WO | 2007129210 | A2 | 11/2007 |

OTHER PUBLICATIONS

International Search Report and Written Opinion for Corresponding International Application No. PCT/IB2018/051240 (9 Pages) (dated May 9, 2018).

*Primary Examiner* — Lamson D Nguyen
(74) *Attorney, Agent, or Firm* — Lucas & Mercanti, LLP

(57) ABSTRACT

A system for transferring graphical representations on an object by sublimation is provided. The system has a first loading device configured to load on a work plane, a support having a graphical representation to be transferred, a second loading device configured to load, the object over the support on the work plane. The system further includes a sublimation apparatus having a catenary, and a plurality of pendulum components hooked to the catenary, each component having ends and jaws configured to cooperate with the work plane so that, by suction, the support wraps the object, is made to adhere to the object and is moved together with the object by way of the catenary in an oven arranged for transferring the support graphical representation from the support to the object. The invention relates also to a method for transferring graphical representations on an object by sublimation.

11 Claims, 7 Drawing Sheets

SYSTEM AND METHOD FOR TRANSFERRING GRAPHICAL IMAGES ON AN OBJECT BY SUBLIMATION

CROSS-REFERENCE TO RELATED APPLICATIONS

This application is a 371 of PCT/IB2018/051240, filed Feb. 27, 2018 which claims the benefit of Italian Patent Application No. 102017000022378, filed Feb. 28, 2017.

TECHNICAL FIELD

The present invention relates, in general, to a system and method for transferring graphical images on an object by sublimation.

In particular, present invention relates to a system and method for transferring graphical images on elongated objects by sublimation.

BACKGROUND ART

Systems for transferring graphical images on objects by sublimation are known.

In general, such systems are configured in such a way that a support comprising the graphical images to be transferred (transfer support) is wrapped around the object and that the support is adhered to the object by creating a vacuum between the support and the object so as to transfer the graphical images from the support on the object by sublimation.

For example, from the document EP1752305 A1 a method is known for decorating an object by sublimation. The known document teaches to wrap up the object to be decorated in a transfer support comprising a plurality of grooves suitable for making a plurality of channels arranged to facilitate the formation of the vacuum and the adhesion of the support to the object.

A problem of this known art is that the transfer support must have special characteristics arranged to grant adhesion of the transfer support to the object.

It is also known, for example from document US20093200748_A, an apparatus for decorating objects wrapped in a transfer support bearing sublimable images. In the known document a conveying device is described for conveying the wrapped object into, and for removing the wrapped object from a heating device by moving the object in substantially vertical direction.

A problem of this known art is that loading and unloading the wrapped object onto/from the conveying device must be manually operated by skilled persons, since the disclosed configuration does not allow that both the adhesion of the transfer support to the object and the separation of the transfer support, after the transfer of the images to the object, be automated.

Applicant, in general, has noted that known art does not effectively solve the problem of automating loading onto and unloading from the conveying and heating devices in a completely automatic manner.

Applicant has also noted that known art is not able to provide effective solutions to facilitate the vacuum creation and the adhesion of the support to the object without the use of transfer supports having special characteristics.

DISCLOSURE OF THE INVENTION

The object of the present invention is to solve the problems of known art outlined above.

The system for transferring graphical images on an object by sublimation as claimed is such to achieve the object.

According to present invention, such an object is achieved by way of a system comprising the features set forth in the claims that follow.

The present invention also relates to a method for transferring graphical images on an object by sublimation.

Claims are an integral part of the teaching of the present invention.

The following summary of the invention is provided in order to provide a basic understanding of some aspects and features of the invention.

This summary is not an extensive overview of the invention, and as such it is not intended to particularly identify key or critical elements of the invention, or to delineate the scope of the invention. Its sole purpose is to present some concepts of the invention in a simplified form as a prelude to the more detailed description that is presented below.

According to a feature of a preferred embodiment, the system for transferring graphical images from a support on an object by sublimation comprises a sublimation apparatus comprising, suspended from a catenary, a plurality of pendulum components configured to support the objects wrapped by suction in respective supports.

According to a further feature of the present invention, the system comprises a first loading device arranged to position the support longitudinally on a work plane, and a second device configured to position the object transversely to the support and to the work plane.

According to another feature of the present invention, the system comprises an unloading device in which the pendulum components are arranged to blow air and detach the support from the object after sublimation, whereby the support and the object can be automatically and selectively unloaded.

BRIEF DESCRIPTION OF DRAWINGS

These and further features and advantages of the present invention will appear more clearly from the following detailed description of a preferred embodiment, provided by way of a non-limiting example with reference to the attached drawings, in which components designated by same or similar reference numerals indicate components having same or similar functionality and construction and wherein.

BEST MODE FOR CARRYING OUT THE INVENTION

Figure 1:
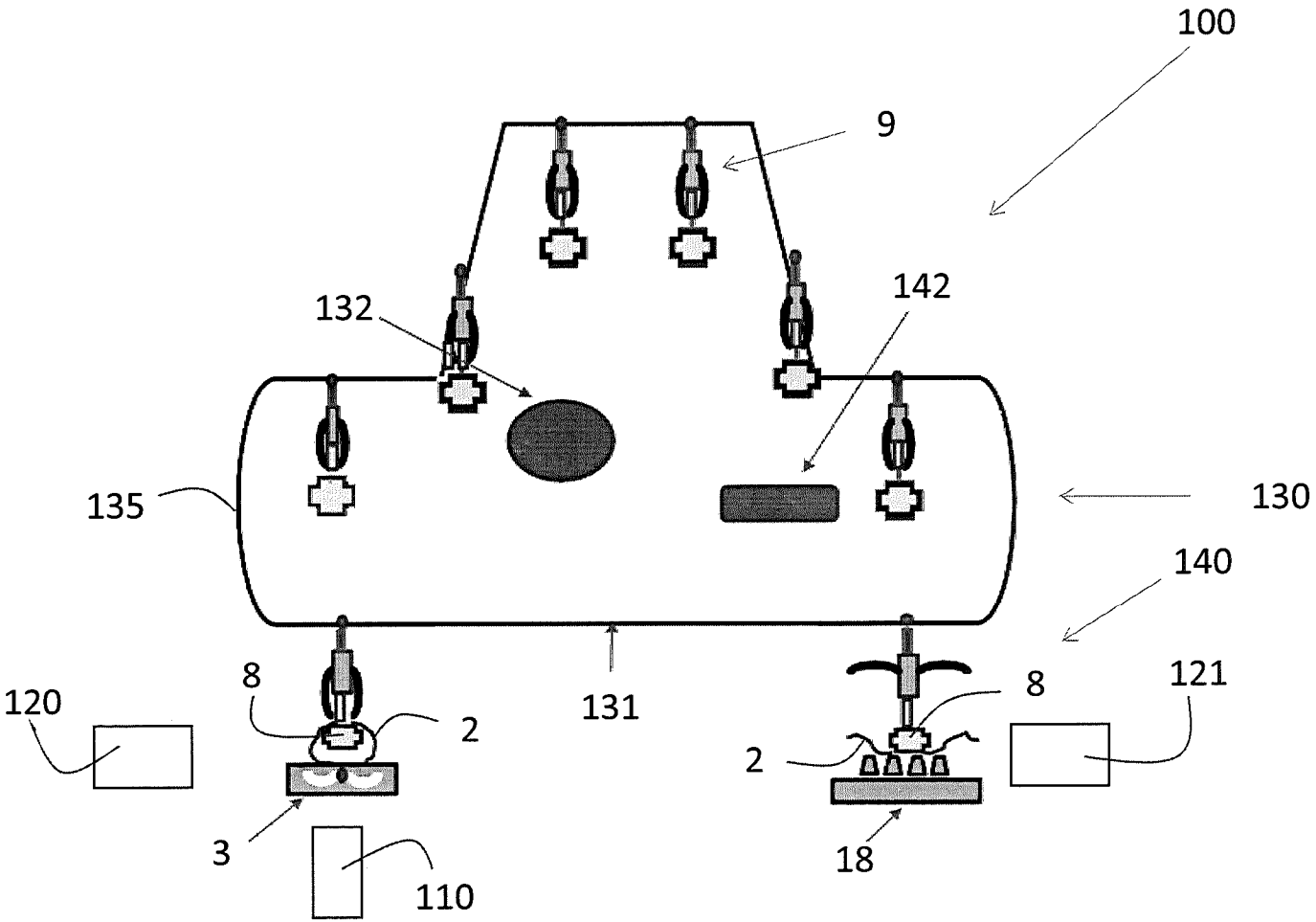
FIG. 1 schematically shows a system for transferring graphical images on an object by sublimation.

With reference to FIG. 1 a system arranged for transferring graphical images by sublimation from a transfer support 2 on walls of an object 8, preferably an elongated object, comprises a transfer support loading device 110, an object loading device 120, a sublimation assembly 130, an unloading device 140 of paper (supports) and objects, and a conveying device 131 arranged for transporting paper and objects in different zones of the system 100.

The system 100, according to the preferred embodiment, is configured to operate in fully automatic way without the need for interventions by skilled persons to load on or unload from the sublimation assembly 130 the object 8 wrapped into the transfer support 2, for example a sheet of material of known type, hereinafter referred to as paper or sheet of paper.

FIG. 1 is a schematic representation of a possible configuration of all the devices of the system and of the path of the transport device 131. As easily understandable by a person skilled in the art, according to other embodiments, as a function of the loading and unloading devices, 110, 120, 140, and of the sublimation assembly 130, the path of the conveying device 131 may be in a clockwise direction, as shown, or in an anti-clockwise direction, without thereby departing from the scope of what is disclosed and claimed.

As a matter of fact, according to a possible different embodiment, the sublimation assembly 130 may be positioned in an intermediate position between the loading devices 110, 120 and the unloading device 140 so as to allow the transport device 131 to have a return path from the unloading device 140 to the loading devices 110, 120 extending in a different zone from that shown in FIG. 1, for example in a zone conventionally upper and external to the sublimation assembly 130.

The paper loading device 110 comprises a module arranged to unwind a strip of paper from a roll 24 of paper 2 and to position it on a work plane 3, preferably longitudinally to the work plane, in a loading position. Preferably, the paper loading device 110 comprises a suction bar 4, arranged to drag the paper 2 by suction from an initial position A of the work plane 3 to a final position B, the bar 4 being carried by a motor 25. Preferably, the suction bar 4 is associated with a belt which carries back the bar 4 in position A underneath the work plane 3 so as to be arranged to repeat a loading cycle of the paper 2 from A to B after a predetermined time.

According to the preferred embodiment, the paper loading device 110 further comprises a paper cutting component 7 arranged to cut the paper (paper sheet) 2 when the suction bar 4 is returned to position A and reactivated to suction, and the working plane is activated to suction so as to retain the paper sheet or transfer support 2 in the loading position.

The object loading device 120, preferably, is arranged orthogonally to the direction of the paper loading device 110 and to the work plane 3 and is arranged to position an object or profile 8 on the paper sheet 2 located on the work plane 3 at the end of the paper loading phase operated by way of the paper loading device 110.

The object loading device 120, as easily understood by a person skilled in the art, can be a fully automatic device arranged to operate according to predetermined time periods in synchronicity with the paper loading device 110, for example under the control of a computerised control unit 121.

The sublimation assembly or apparatus 130 comprises the working plane 3, the conveying device 131 and a heating unit (oven) 132 of known type, configured for carrying out the sublimation of the images on the transfer support 2 to the object 8, and, preferably, cooling components 142.

The work plane 3, preferably a suction plane of known type, comprises, along the whole plane on which, in use, the paper sheet 2 is retained, a plurality of pliers 6, preferably pliers which comprise suction ends and are normally kept open.

The work plane 3 is configured so as to comprise longitudinal openings in the work plane suitable for allowing the pliers 6, for example pliers located longitudinally to the work plane, to exit from the work plane 3 and lift the paper 2 so as to wrap, in use, the object 8.

The conveying device 131 is arranged to cooperate with the working plane 3 so as to hook the object 8 wrapped onto the paper sheet 2 and transport it to the oven 132 in which sublimation is carried out.

In particular, the conveying device 131 comprises a catenary 135, for example a catenary with a width equal to or slightly greater than that of the work plane 3, and a plurality of pendulum or pendulum components 9, hooked, in a known way, along the catenary 135.

The catenary 135 is arranged to be moved with predetermined periods of stop and advancement, for example under the control of the control unit 121.

Each pendulum 9 comprises, according to the preferred embodiment, at least one pin 16 connected to the catenary 135, a set of jaws or pliers, 10A-10B, comprising, preferably, suction ends, and a set of pendulum ends 11 connected, in a known way, to a duct 12 and adapted, in use, to suck up or blow air as a function of the area or zone in which the catenary 135 is working. According to the preferred embodiment, the pendulum ends 11 protrude from the jaws, when the jaws 10A-10B are closed.

According to the preferred embodiment, it is provided in a first step that, in use, after the object or profile 8 has been located on the paper sheet 2 on the work plane 3, the work plane 3, with the suction pliers 6 open, is raised, in a known way, up to a predetermined distance from the pendulum 9, for example up to one centimetre from the pendulum.

In the meantime, the catenary 135, for example under the control of the control unit 121, is kept still in a vertical position with respect to the object 8 and the pliers 6 raise the paper sheet 2 and press it against the pendulum ends 11, that are activated to suck up air to wrap the object 8 with the paper 2.

In a step immediately following the first step the jaws 10A-10B of the pendulum 9 are closed, the pliers 6 of the working plane 3, preferably of suction type, are opened and the working plane 3 is lowered to the loading position.

Thanks to these steps in succession, the paper 2, due to the suction carried out by the pendulum ends 11, adheres to the profile 8 that remains raised from the work plane 3 so as to be transported into the oven 132 in a completely automatic manner without the need for interventions of skilled persons.

After closing the jaws or pliers 10A-10B, the catenary starts to advance and the profile 8, wrapped on the paper 2 and suspended from the pendulum 9, active in suction in this zone, is conveyed by way of the catenary in the oven 132, where it is subjected to sublimation.

According to the preferred embodiment, it is also provided that the unloading phase of the object 8, after sublimation, takes place completely automatically by way of a paper and object unloading device 140, without the need for intervention by skilled persons.

In particular, according to the preferred embodiment, the paper and object unloading device 140 comprises an unloading belt 18, preferably a conveyer type belt, an accumulation belt 22 for accumulating objects 8, positioned at a predetermined distance from the unloading belt, and a collection component 23, comprising e.g. a suction roll 21 for removing paper, the suction roll being positioned between the unloading belt 18 and the accumulation belt 22, and arranged to collect the paper 2, after sublimation.

Preferably, it is provided that the catenary 135 is advanced so as to pass from the oven 132 to a zone in which the object 8, after sublimation, is cooled, and then, to a zone positioned near the unloading belt 18 comprised in the paper and object unloading device 140 arranged to automatically and selectively unload the paper and the sublimated object.

In particular, in the cooling zone, for example, cooling is carried out, in a known way, by way of cooling components 142, for instance fans.

In the area near the discharge device 140 it is provided that, according to the preferred embodiment, air is blown at the pendulum ends 11 so as to detach the paper 2 from the sublimated object 8, and that, at the same time, the jaws 10A-10B are opened.

Thanks to these operations, the object 8 and the paper 2, detached from the object, fall onto the discharge belt 18 which is arranged to move the paper 2 and the object 8 towards the accumulation belt 22.

The paper 2, being already detached from the object 8 and being lighter than the object, is sucked, for example, by the roller 21 and is automatically dropped into the collection component or paper collector 23 interposed between the discharge belt 18 and the accumulation belt 22, while the object 8, still in automatic way, is accumulated on the accumulation belt 22.

The operation of the system as described above is the following.

Figure 2:
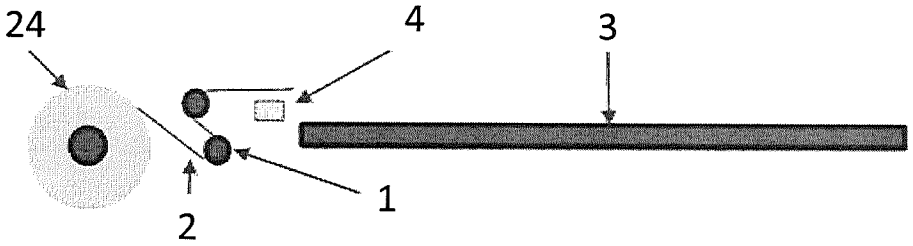
FIG. 2-FIG. 5 schematically show operative steps for loading objects and supports comprising graphical images in the system of FIG. 1.
Figure 3:
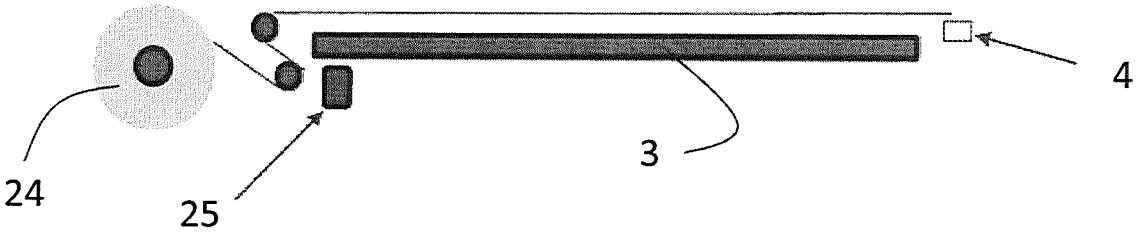
Figure 4:
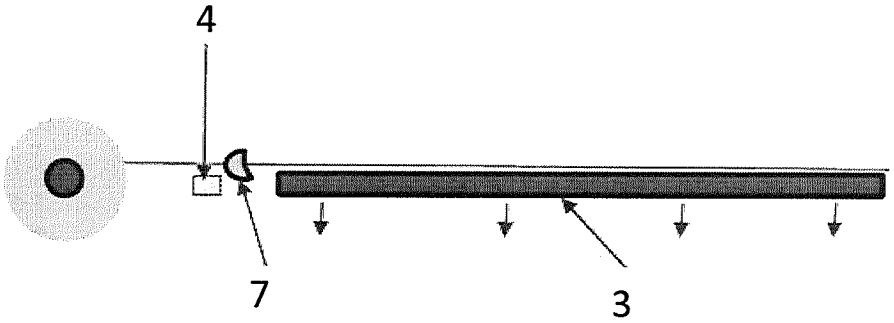

In a first step (FIG. 2-FIG. 4), herein named transfer support loading step, the transfer support 2 is taken from the roll 24 by way of a spool unwinding device 1 through the suction bar 4 located in the starting position A.

In this step or phase, the suction bar 4 is moved by way of the motor 25 from position A to position B by dragging the paper 2 on the work plane 3.

When the suction bar 4 is in position B, a suction valve of known type is activated on the work plane 3 and, preferably, simultaneously the suction pliers 6 are activated so as to lock the paper 2 on the work plane 3. Moreover, once the paper 2 has been locked on the work plane 3, suction of the suction bar 4 is preferably blocked, and the suction bar 4 is returned to the initial position A, where the suction is activated again so that the suction bar 4 takes the paper 2.

On this step, when the suction bar has taken the paper in the initial position A, the paper cutting component 7 is activated, so as to separate the paper present on the roll 24 from that on the work plane 3.

Figure 5:
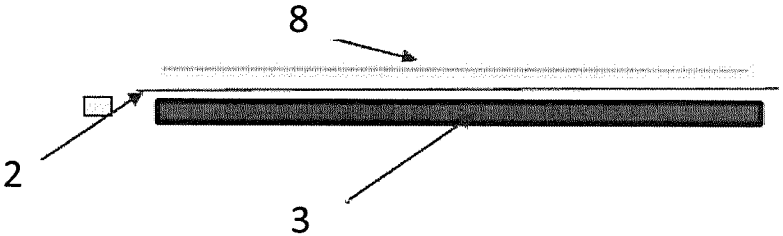
Figure 6A:
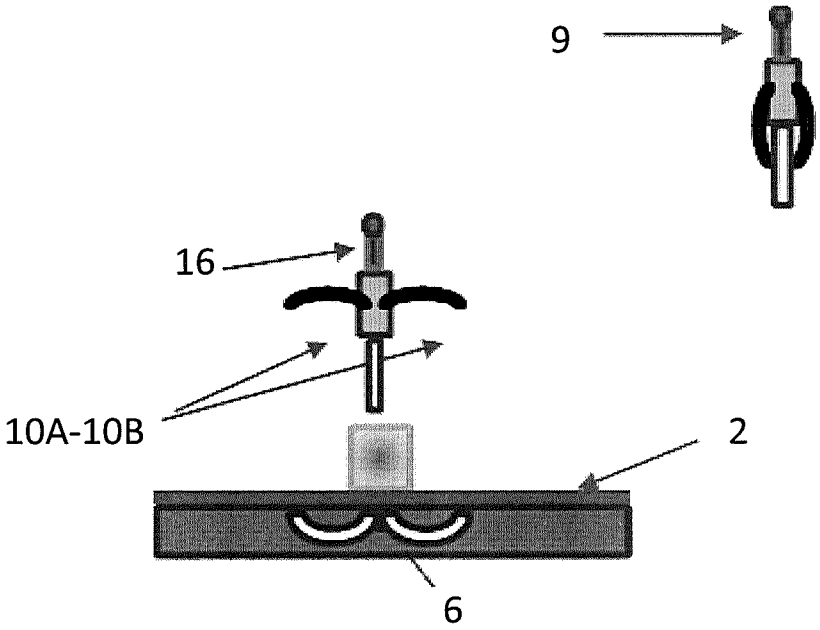
FIG. 6*a*-6*e* and FIG. 7*a*-7*b* schematically show components of an assembly or apparatus of the system of FIG. 1.
Figure 6B:
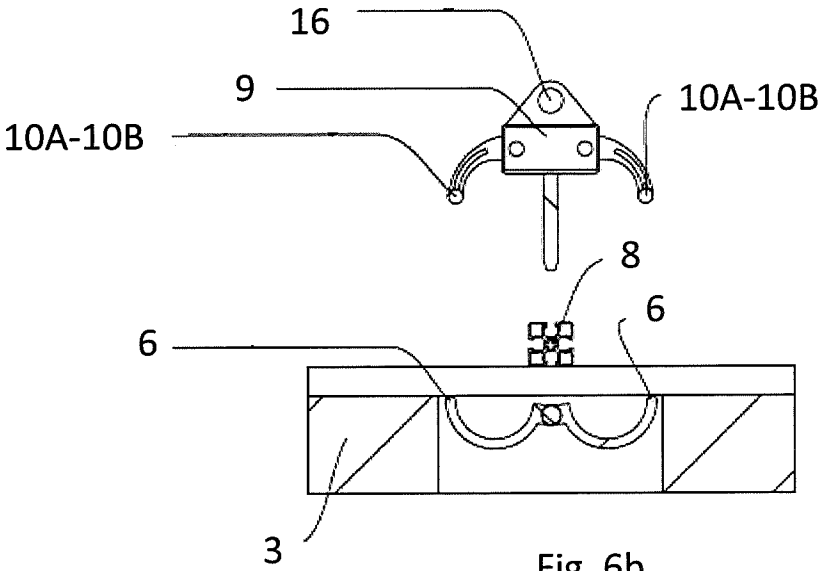
Figure 6E:
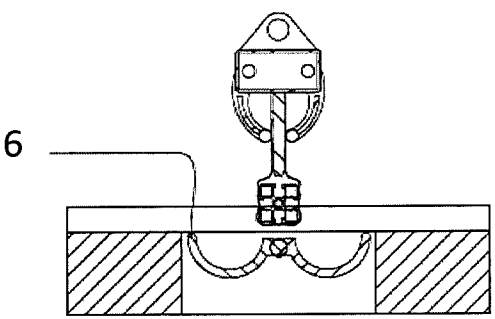
Figure 6D:
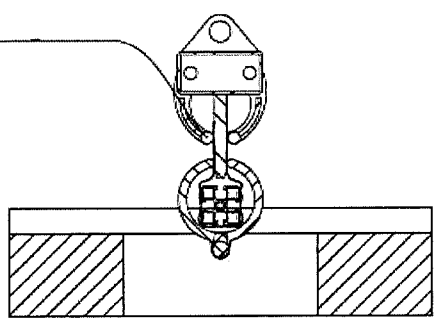
Figure 6C:
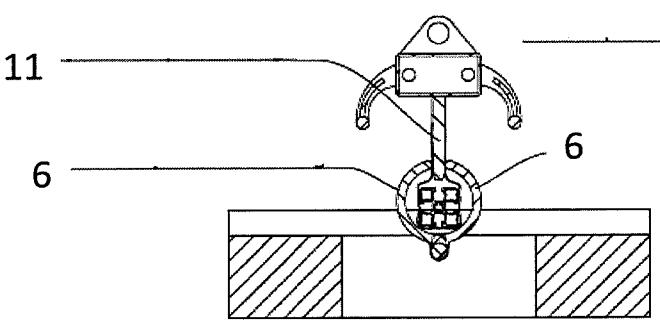
Figure 7B:
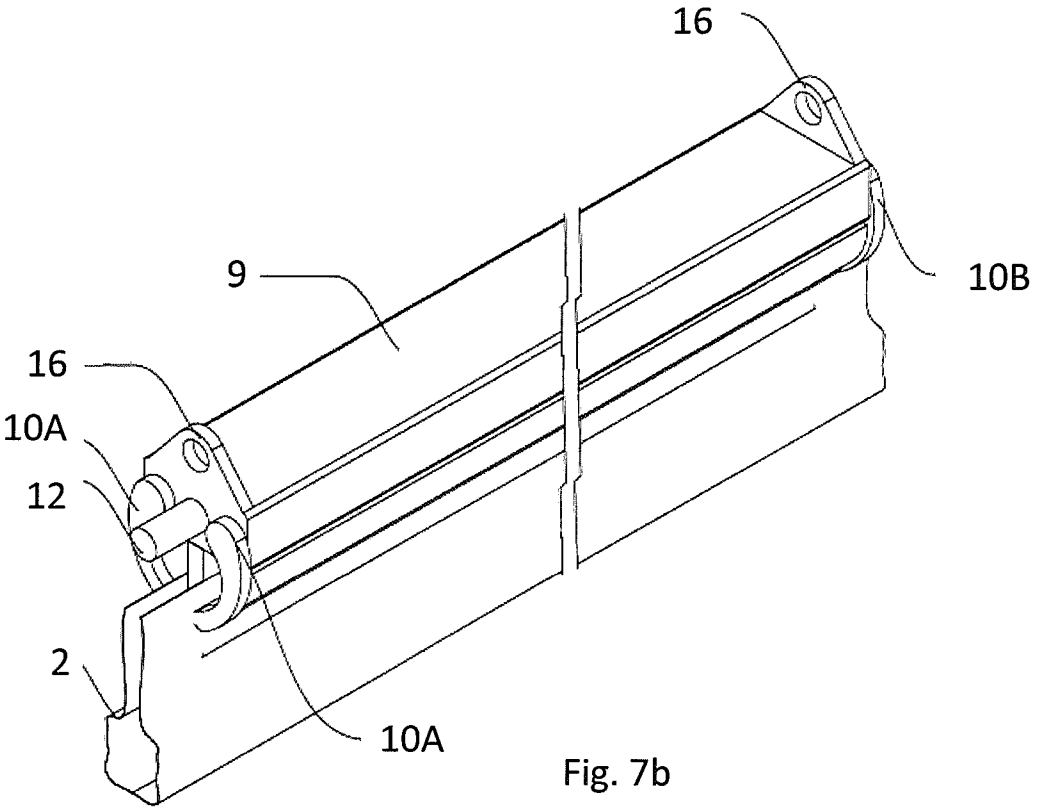
Figure 7A:
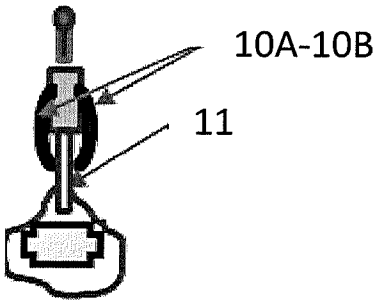

In a second step (FIG. 5), herein named object loading step, the profile 8 to be sublimed is placed, preferably in an automatic way, on the paper 2 which is on the working plane 3, by way of the object loading device 120.

In a third step (FIG. 6*a*-FIG. 6*e*, FIG. 7*a*-FIG. 7*b*), herein named sublimation phase, the pendulum 9, connected by way of the pin 16 to the catenary 135 and carried by the catenary 135, is positioned vertically with respect to the profile 8 already placed on the work plan 3.

Initially, in this step or phase, while the jaws 10A-10B of the pendulum 9 are open, the work plane 3, with the pliers 6 open, is raised up to the predetermined distance from the pendulum 9.

Subsequently, the pliers 6, preferably suction pliers, press the paper against the pendulum ends 11, active in suction in this area, the jaws 10A-10B are closed, the pliers 6 of the work plane 3 are opened, and the paper 2, as a result of suction of the ends 11 of the pendulum 9, is made to adhere to all the walls of the object 8. In this phase, the object 8, wrapped on the paper 2 and hung from the pendulum 9, is carried by the catenary 135 to the oven 132 where it is subjected to heating, and after sublimation, is carried to cooling.

Figure 8:
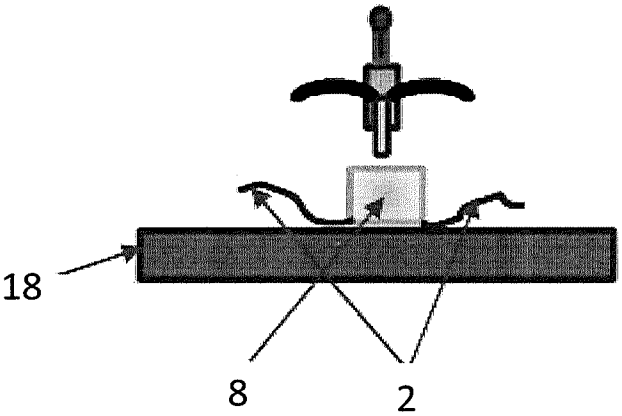
FIG. 8 and FIG. 9 schematically show a device for unloading objects and supports from the system of FIG. 1.
Figure 9:
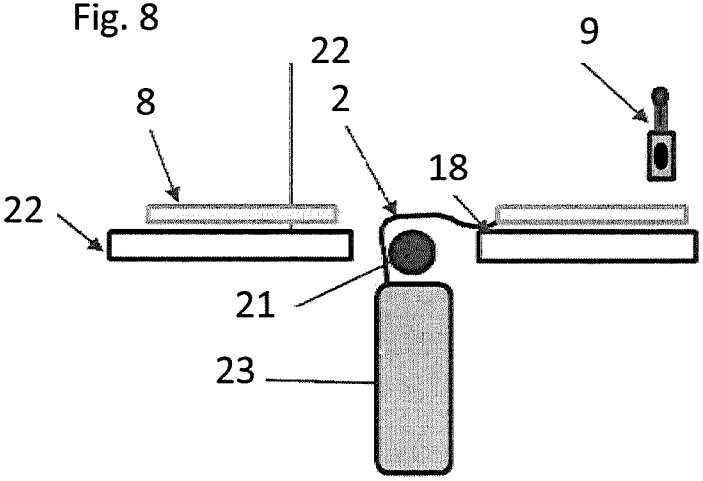

In a fourth step (FIG. 8, FIG. 9), herein named unloading phase of the object 8, after sublimation, air is blown through the pendulum ends 11, that are arranged to blow air in this area, so that the paper swells up and detaches from the sublimated walls of the object 8. Switching from suction to blow of the pendulum ends 11 in the different zones in which the catenary 135 is operative, is made by way of known type means, as for example by way of mechanically or electrically controlled valves.

In this phase it is also provided that the pendulum 9 is located in the area in which the discharge device 140 is present, whereby it is also provided that the jaws 10A-10B are opened and that the profile is made to lie down on the discharge belt 18 of the unloading device 140.

In this phase it is also provided that the unloading belt 18, for example under control of the control unit 121, is activated so as to transport the profile 8 towards the accumulation belt 22 whereby the paper, for example sucked by the suction roll 21, is conveyed into the paper collection component 23 while the sublimated profile 8 is driven to the accumulation belt 22.

Advantageously, the system 100 as disclosed does not require interventions by skilled persons as regards paper loading, objects loading, sublimation and unloading of paper and objects.

Advantageously, loading of paper and objects on the sublimation assembly can be made automatic thanks to the presence of a pendulum arranged to adhere paper to the object without the need for welding on the paper that wraps the object.

Even more advantageously, thanks to the absence of welds on the paper, the paper can be unloaded automatically using the double function of suction and blowing provided to the pendulum ends.

Of course, obvious changes and/or variations to the above disclosure are possible, as regards shapes, components and connections as well as details of the described construction and operation method without departing from the scope of the invention as defined by the claims that follow.

The invention claimed is:

1. A system for transferring graphical representations on an object by sublimation, said system comprising:

a first loading device configured to load on a work plane a support comprising a graphical representation to be transferred, a second loading device configured to load, in use, the object over said support on said work plane, and a sublimation apparatus comprising a catenary, and a plurality of pendulum components hooked to the catenary, each pendulum component comprising ends and jaws configured to cooperate with the work plane so that, by suction, said support wraps said object, is made to adhere to said object and is moved together with the object by way of the catenary in an oven arranged for transferring the support graphical representation from the support to the object, wherein said work plane comprises a plurality of pliers arranged longitudinally to the work plane and configured to wrap the object by way of the support and make the support adhere to said ends of said pendulum component.

2. The system according to claim 1, wherein said pliers comprise suction type ends.

3. The system according to claim 2, wherein said first loading device is configured to position said support longitudinally to the work plane and said second loading device is configured to position said object transversely to said support and to said work plane.

4. The system according to claim 2, further comprising an unloading device arranged to unload said support and said object, said ends of said pendulum component being arranged to blow air and detach said support from said object, said jaws being arranged to be open in correspondence of said unloading device, whereby said support and said object are arranged to be automatically and selectively unloaded.

5. The system according to claims 1, wherein said first loading device is configured to position said support longitudinally to the work plane, and said second loading device is configured to position said object transversely to said support and to said work plane.

6. The system according to claim 5, further comprising an unloading device arranged to unload said support and said object, said ends of said pendulum component being arranged to blow air and detach said support from said object, said jaws being arranged to be open in correspondence of said unloading device, whereby said support and said object are arranged to be automatically and selectively unloaded.

7. The system according to claim 1, further comprising an unloading device arranged to unload said support and said object, said ends of said pendulum component being arranged to blow air and detach said support from said object, said jaws being arranged to be open in correspondence of said unloading device, whereby said support and said object are arranged to be automatically and selectively unloaded.

8. A method for transferring graphical representations on an object by sublimation, the method comprising:

loading on a work plane a support comprising a graphical representation to be transferred, loading an object over said support, wrapping, by suction, and in cooperation with said work plane, said object with said support through a pendulum component comprising jaws and ends, said pendulum being hooked to a catenary, making to adhere said support to said object, by suction, supporting said support and said object by suction, and moving said support and said object by way of the catenary in an oven for transferring the graphical representation from the support to the object, wherein said wrapping by suction said object with said support comprises:

activating on the work plane a plurality of pliers arranged longitudinally to the work plane, and wrapping with said support said object in such a way that the support is made to adhere to the ends of said pendulum suction activated.

9. The method according to claim 8, wherein said loading on a work plane a support and said loading an object over said support are activated in sequence maintaining the work plane in a loading position.

10. The method according to claim 9, further comprising:

unloading said support and said object, after the transfer of the graphical representation from the support to the object, said unloading comprising:

detaching said support from said object by air blowing, opening the jaws of said pendulum, and separately unloading, automatically and selectively, said support and said object.

11. The method according to claim 8, further comprising:

unloading said support and said object, after the transfer of the graphical representation from the support to the object, and said unloading comprises:

detaching said support from said object by air blowing, opening the jaws of said pendulum, and separately unloading, automatically and selectively, said support and said object.

* * * * *